US005322220A

United States Patent [19]

Rehkemper

[11] Patent Number: 5,322,220

[45] Date of Patent: Jun. 21, 1994

[54] TOY INK APPLICATOR

[75] Inventor: Steven Rehkemper, Chicago, Ill.

[73] Assignee: Rose Art Industries, Inc., Orange, N.J.

[21] Appl. No.: 69,860

[22] Filed: Jun. 1, 1993

[51] Int. Cl.[5] ..... B05B 3/02; B05C 17/12

[52] U.S. Cl. ..... 239/214; 239/103; 222/414

[58] Field of Search ..... 239/120, 121, 219-221, 239/214, 326, 103, 222; 222/414; 118/DIG. 16

[56] References Cited

U.S. PATENT DOCUMENTS

| | | | |
|---|---|---|---|
| 487,396 | 12/1892 | Siegert . | |
| 1,016,143 | 1/1912 | Hansen . | |
| 1,099,344 | 6/1914 | Pilsworth . | |
| 1,218,279 | 3/1917 | Kopinski . | |
| 1,272,752 | 7/1918 | Wold . | |
| 1,862,430 | 6/1932 | Robb . | |
| 3,091,403 | 5/1963 | Schraber . | |
| 3,304,573 | 2/1967 | Stefely . | |
| 3,429,642 | 2/1969 | Underwood . | |
| 3,554,450 | 1/1971 | D'Muhala . | |
| 3,866,838 | 2/1975 | Miles . | |
| 3,921,858 | 11/1975 | Bemm . | |
| 4,628,644 | 12/1986 | Somers . | |
| 4,951,876 | 8/1990 | Mills . | |
| 5,088,903 | 2/1992 | Tomatsu . | |
| 5,131,598 | 7/1992 | Hoogeveen, Jr. | 239/214 |
| 5,156,684 | 10/1992 | Mayer et al. | 239/326 |
| 5,190,220 | 3/1993 | Bolton | 239/326 |

FOREIGN PATENT DOCUMENTS

| | | | |
|---|---|---|---|
| 1282259 | 7/1972 | United Kingdom | 239/214 |

OTHER PUBLICATIONS

Colorblaster TM Instruction Sheet, date unknown.

*Primary Examiner*—Karen B. Merritt
*Attorney, Agent, or Firm*—James & Franklin

[57] ABSTRACT

The hand held housing has a depressible trigger effective when actuated to energize a motor. The motor drives a cylindrical brush to rotate within the housing. As the brush rotates, the ends of the radially extending bristles contact and remove ink from the conical surface of the felt tip of a marker, the end of which extends through an opening into the interior of the housing. Ink removed from the marker is propelled through another opening in the housing in a stream.

12 Claims, 7 Drawing Sheets

TOY INK APPLICATOR

The present invention relates to an ink applicator adapted for creating drawings and designs which have the appearance of having been formed by an air brush and more particularly to such an applicator which is suitable for use by children, in that it is inexpensive, portable, light weight and safe, as well as being made of a minimum of simple parts which function together reliably.

Ink is commonly used for writing and drawing. It has been applied for many years through the use of pens with metal tips. More recently, felt tip markers have become common. Such markers include plastic cylindrical barrels which contain an ink saturated absorbent material which supplies the felt tip.

Whether metal or felt, the tip must physically contact the surface to apply the ink. Because of this, the configuration of the tip limits the manner in which the ink can be applied. Fairly uniform markings with well defined boundaries result. Little variation is possible other than that which results from changes in the pressure applied.

Brushes have similar limitations in that physical contact between the brush and surface is required. However, there are so called "air brushes" which overcome some of the limitations of brushes through the use compressed air which propels a fine spray of droplets on to a surface. These air driven devices may be used to produce a wider range of asthetically pleasing effects than is normally possible with pens, markers or paint brushes. Unlike other types of applicators, the air driven devices permit control over the intensity of the deposits as the applicator is moved toward and away from the surface being colored and therefore allow a greater degree of artistic creativity.

However, air brushes require a cumbersome and expensive air compressor. An air compressor is a power driven machine which builds up a high pressure. It must be used carefully and is not appropriate for use by children.

The Kenner division of Tonka Corporation has attempted to design an air driven children's toy applicator called a "colorblaster". That device employs a manually operated pump to pressurize a plastic air storage tank. The pressurized air from the storage tank is directed through a sprayer which holds a specially designed felt tip marker. The marker has a felt tip with a channel. The air passes through the channel to produce a stream of ink droplets.

However, that system does not work satisfactorily. The pump does not result in an air stream which maintains with a uniform pressure. The pressurized air in the storage tank is used up quickly, requiring frequent pumping. It is very difficult for a child to pump the apparatus to attain the necessary air pressure. Markers with specially designed cylindrical tips with axial channels are required as the ink supply. Moreover, the cost of that applicator is relatively high for a toy and the specially designed markers are also fairly expensive.

The present invention overcomes these disadvantages by providing an applicator which is simple, portable, safe and inexpensive enough for use by children but at the same time provides the control and asthetically pleasing results of an air brush. In general, this is achieved by eliminating the compressed air stream entirely and using instead a rapidly rotating cylindrical brush to remove ink from a marker tip and propel the ink stream onto the surface being colored.

It is, therefore, a prime object of the present invention to provide a toy ink applicator which provides the control and asthetically pleasing effect of an air brush.

It is another object of the present invention to provide a toy ink applicator which eliminates the necessity for a compressed air stream.

It is another object of the present invention to provide a toy ink applicator which utilizes markers with conically shaped felt tips as an ink supply.

It is another object of the present invention to provide an air brush type applicator which is simple, portable, safe and inexpensive enough to be used by children.

In accordance with one aspect of the present invention, a toy ink applicator is provided for use with an ink containing marker having an end with an exposed felt tip. The applicator has a power source and a hand-held housing. The housing has a depressible actuator and a motor with a drive shaft. Means are provided for connecting the power source to energize the motor when the actuator is depressed. Brush means are provided in the housing. Means are provided for moveably mounting the brush means within the housing. Means are also provided for operably drivingly connecting the motor drive shaft and the brush to move the brush when the motor is energized. A first opening is provided in the housing which is adapted to permit insertion of the end of the marker. The marker is situated in a position where the moving brush contacts and removes ink from the felt tip. A second opening is provided in the housing through which ink removed from the felt tip is propelled.

The brush comprises a core and plurality of bristles mounted on and substantially radially extending from the core. The brush has a substantially cylindrical configuration.

The means for moveably mounting the brush comprises means for rotatably mounting the brush. More specifically, it includes means for rotatably mounting the core of the brush in the housing.

In accordance with another aspect of the invention, a toy ink applicator and an ink containing marker with an end with an exposed felt tip are provided in combination. The applicator comprises a power source and a hand held housing. The housing has a depressible actuator and a motor with a drive shaft. Means are provided for connecting the power source to energize the motor when the actuator is depressed. Brush means are provided along with means for moveably mounting the brush means within the housing. Means are provided for operably drivingly connecting the drive shaft and the brush means to move the brush means when the motor is energized. A first opening is provided in the housing which is adapted to receive the end of the marker such that the moving brush contacts and removes ink from the felt tip of the marker. A second opening is provided in the housing through which ink removed from the felt tip is propelled by movement of the brush means.

Preferably, the felt tip has a substantially conical surface and an axis. The brush means comprises a plurality of substantially radially extending bristles with ends. The ends of the bristles contact the inclined surface of the conical or wedge shaped marker tip when the brush moves. The brush means rotates about an axis substantially perpendicular to the axis of said felt tip.

To these and to such other objects which may hereinafter appear, the present invention relates to a toy ink applicator as described in detail in the following specification and recited in the annexed claims, taken together with the accompanying drawings wherein like numerals refer to like parts and in which:

Figure 1:
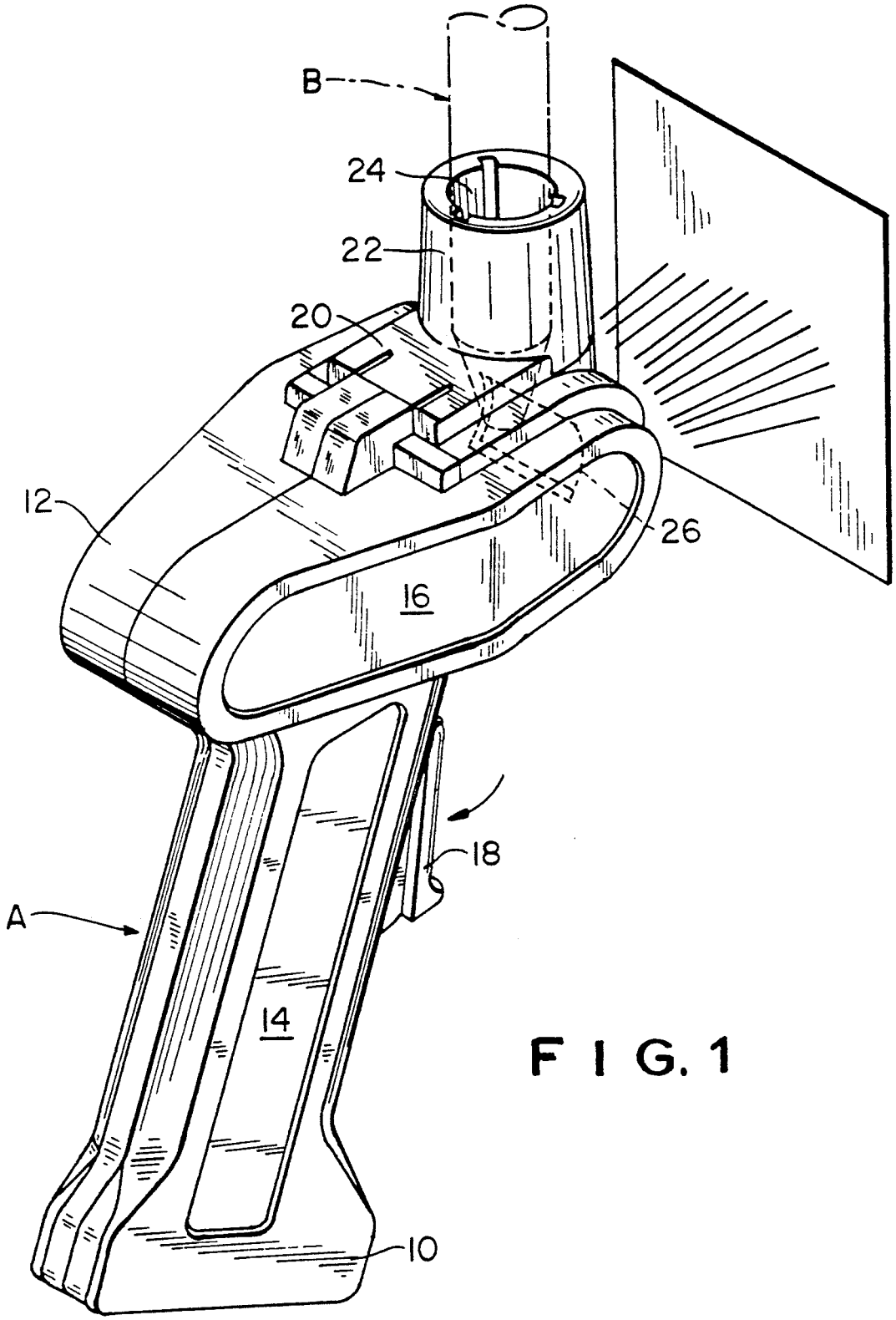
FIG. 1 is an isometric view of the invention showing same with marker inserted and an ink stream being propelled.
Figure 2:
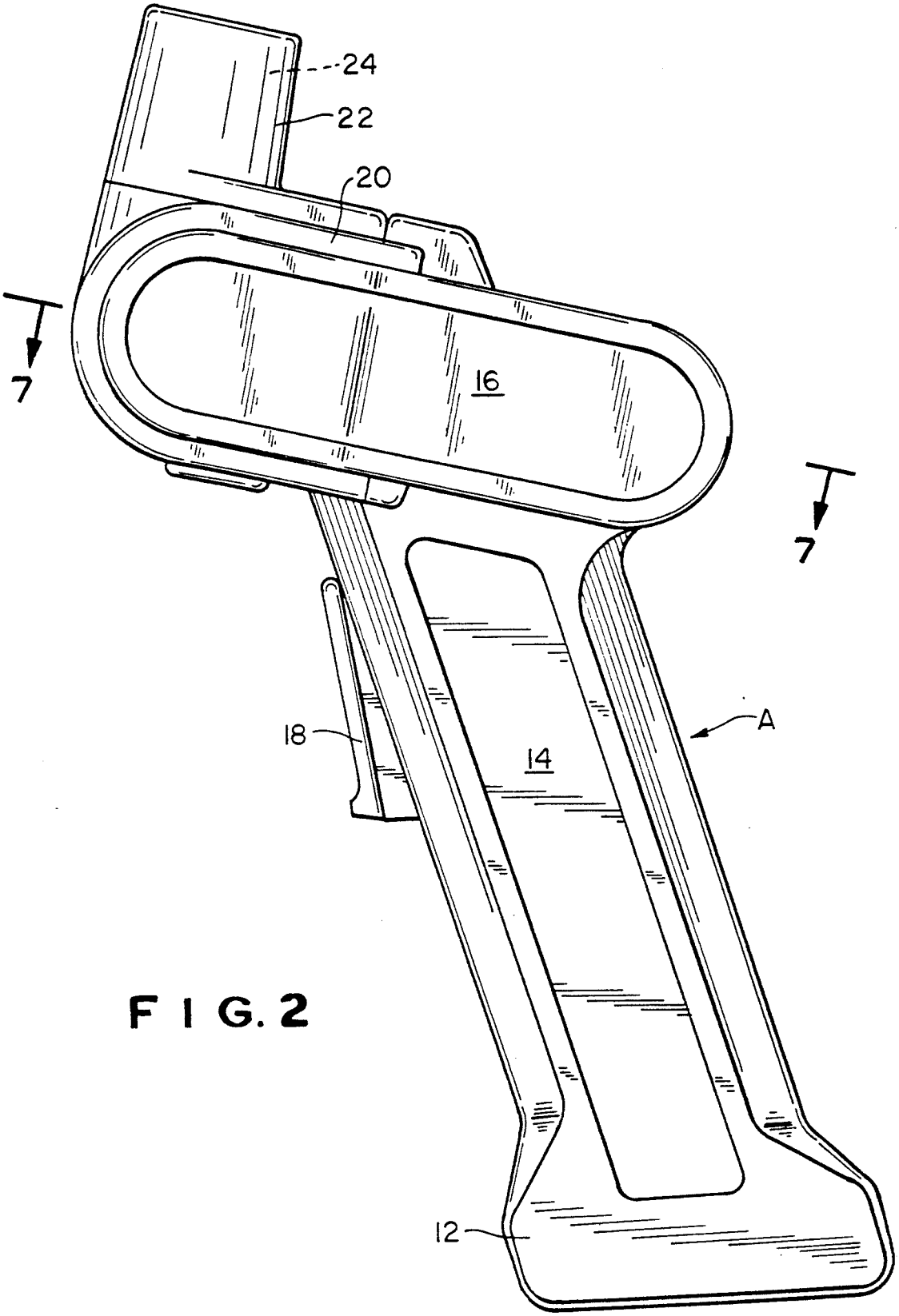
FIG. 2 is a side plan view of the applicator.
Figure 3:
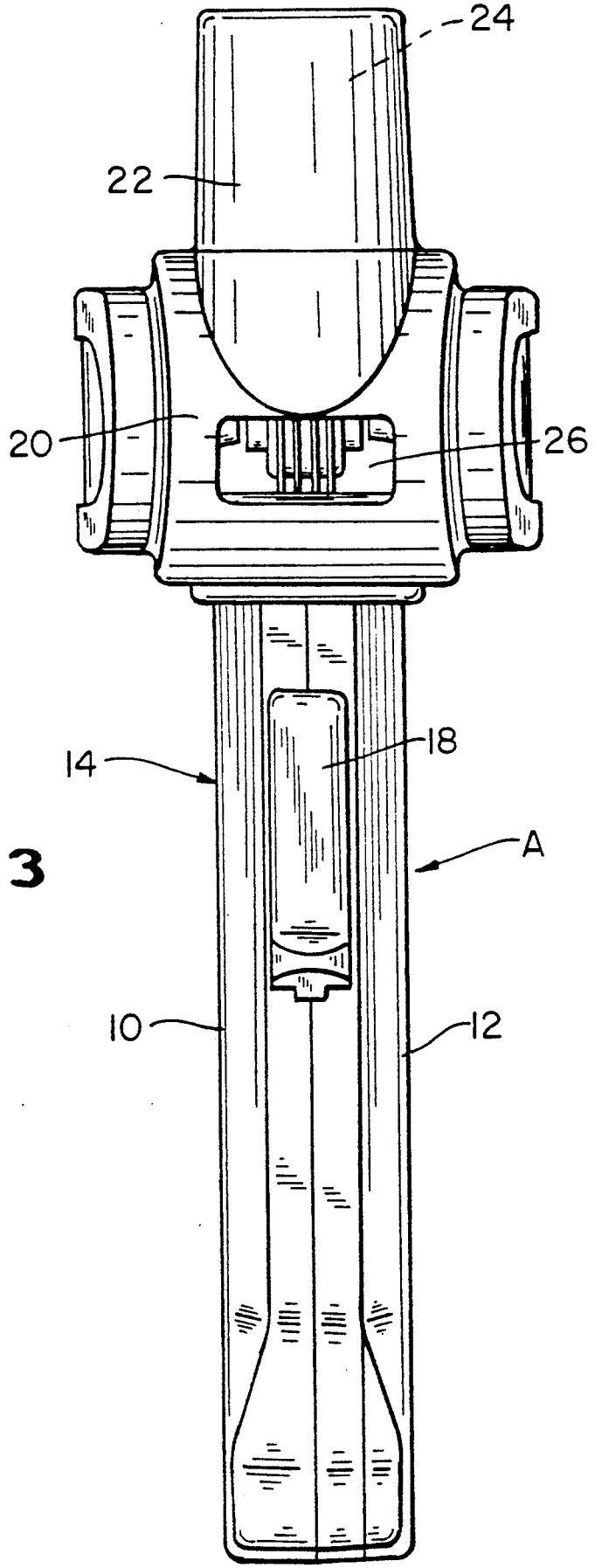
FIG. 3 is a front plan view of the applicator.
Figure 4:
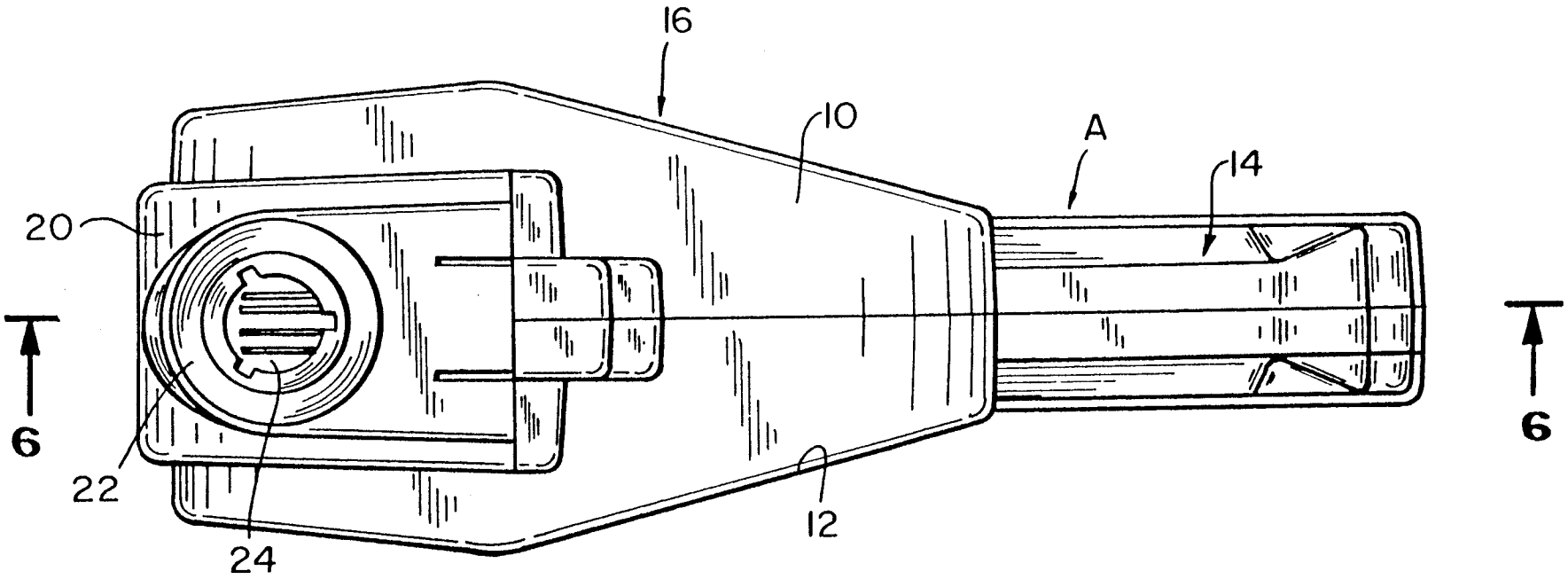
FIG. 4 is a top plan view of the applicator.
Figure 5:
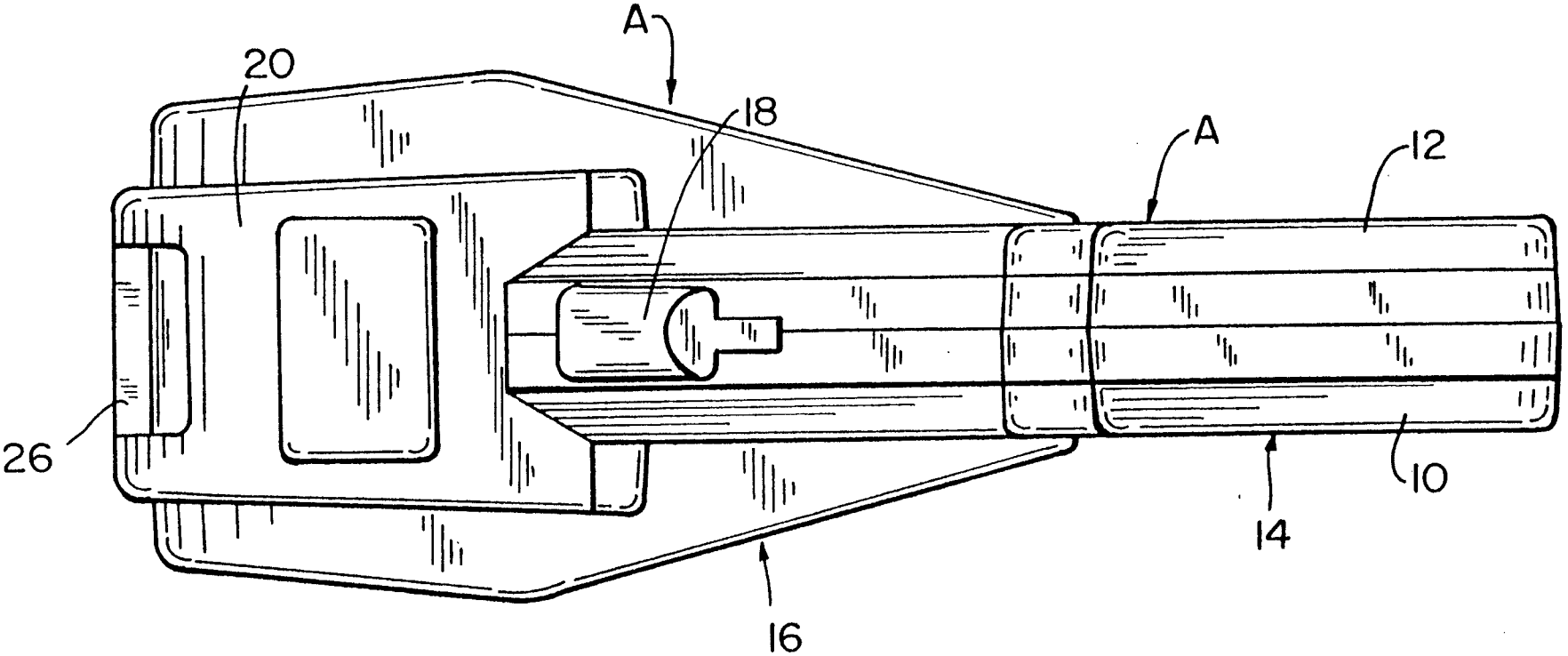
FIG. 5 is a bottom plan view of the applicator.

As shown in FIGS. 1 through 5, the applicator of the present invention includes a pistol grip, handheld housing, generally designated A. Housing A is made from a pair of mirror image injection molded plastic housing halves 10, 12 which are fastened together by a conventional means, such as screws, not shown.

Housing A has a pistol grip or handle portion 14 and a body portion 16. Portion 16 has a generally oval shape, when viewed from the side. A depressible trigger 18 is mounted on the front edge of handle 14.

On the front of body portion 16 is removably mounted a generally "U" shaped part 20. Part 20 has a hollow cylindrical upstanding neck 22 defining a circular opening 24. The front of part 20 has a generally rectangular opening 26.

Circular opening 24 is dimensioned to accept the neck or end of the cylindrical barrel of a felt tipped marker, generally designated B, which is received in neck 22, as indicated in phantom in FIG. 1. Gravity and friction hold marker B in position within neck 22. Marker B preferably has an inclined surface as part of a conical or wedge shaped felt tip. The marker contains a water based ink.

Rectangular opening 26 is a port through which the propelled ink stream exits housing A. It is situated at the front of the housing and is large enough to permit a relatively wide stream.

Figure 6:
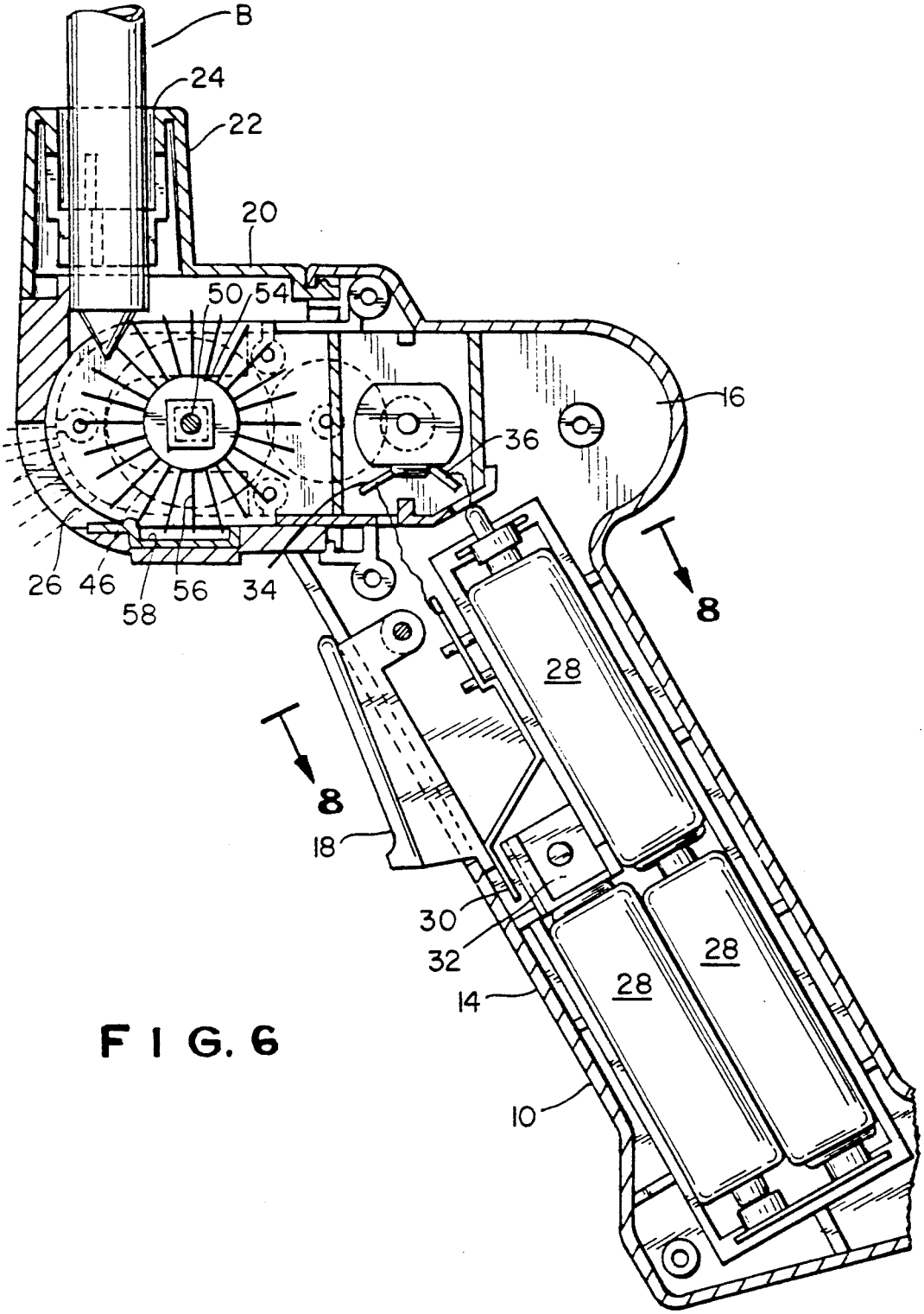
FIG. 6 is a cross-sectional view taken along line 6—6 of FIG. 4.
Figure 7:
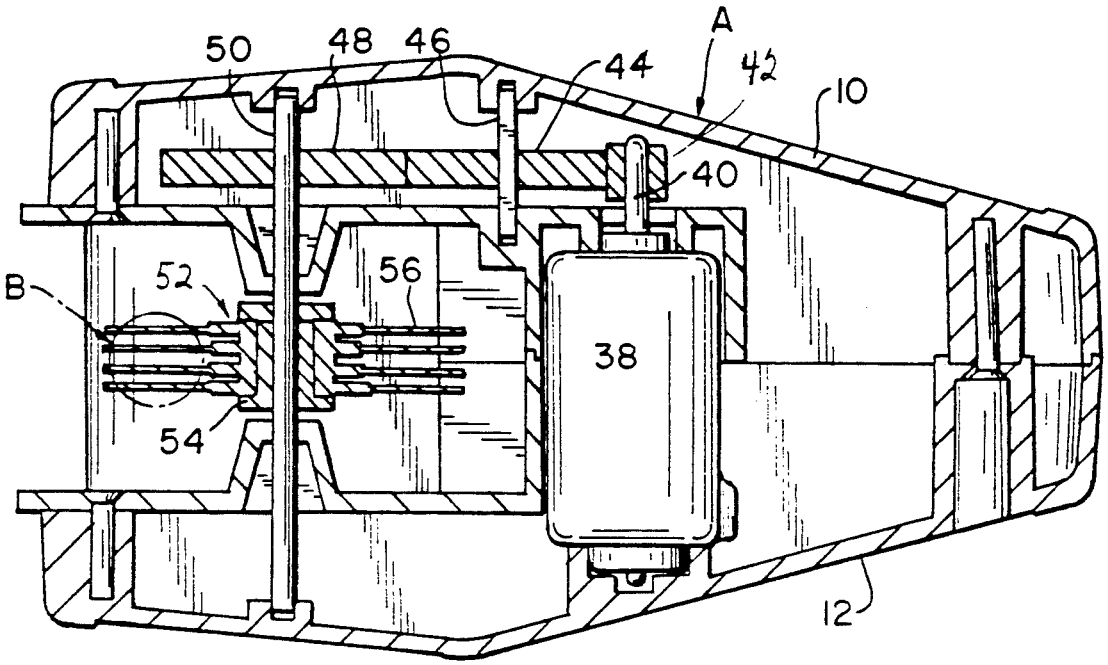
FIG. 7 is a cross-sectional view taken along line 7—7 of FIG. 2.
Figure 8:
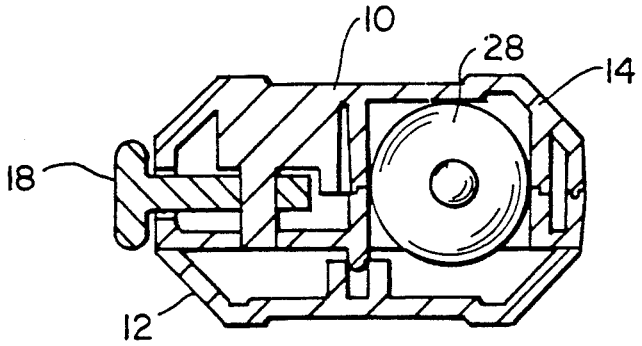
FIG. 8 is a cross-sectional view taken along line 8—8 of FIG. 6.

Referring now to FIGS. 6, 7 and 8, three batteries 28, connected in series, are situated in handle 14. Trigger 18, when depressed, causes a resilient metal contact 30 to abut terminal 32 thereby completing an electrical circuit connecting the terminals 34, 36 of motor 38 to batteries 28, to energize the motor.

As best seen in FIG. 7, motor 38 has an output shaft 40 which carries a gear 42. Gear 42 rotates a second gear 44 which is rotatably mounted on a shaft 46. Gear 44 in turn meshes with a third gear 48 which is fixed on a rotatable shaft 50. Shaft 50 is perpendicular to the axis of the tip of the marker.

Mounted on the center of shaft 50 is a cylindrical brush 52 and more particularly a brush core 54. A plurality of rows of radially outwardly extending, relatively stiff bristles 56 are spaced around the surface of core 54. The surface of felt tip of marker B is situated to contact the tips of bristles 56 when the marker is received within opening 24.

Brush 52 is rotated rapidly upon energization of motor 38 by depression of trigger 18. The rotating output shaft 40 of motor 38 rotates gears 42, 44 and 46, shaft 50 and core 54. The rotating brush bristles remove droplets of ink from the tip of marker B and propels them in a stream out opening 26.

At the bottom of part 20 is a recess 58 which acts as a reservior to collect any ink from brush 52 which is not propelled out of opening 26. Part 20 is made detachable so that it can be easily removed to permit the reservoir to be cleaned.

It will now be appreciated that the present invention is a toy ink applicator which propells a stream of ink in a fashion similar to an air brush but does not utilize a pressurized air stream or rely on an air compressor. In this way, a simple, safe portable and inexpensive toy is obtained which permits a great deal of artistic expression.

While only a simple embodiment of the present invention as disclosed for purposes of illustration, it is obvious that many variations and modifications could be made thereto. It is intended to cover all of these variations and modifications which fall within the scope of the present invention as defined by the following claims:

I claim:

1. A toy ink applicator for use with an ink containing marker having an end with an exposed felt tip, said applicator comprising a power source, a hand-held housing including a depressible actuator, a motor with a drive shaft, means for connecting said power source to energize said motor when said actuator is depressed, a brush, means for moveably mounting said brush within said housing, means for operably drivingly connecting said drive shaft and said brush to move said brush when said motor is energized, a first opening in said housing adapted to permit insertion of the end of the marker into said housing to a position where said moving brush contacts and removes ink from the felt tip and a second opening in said housing through which ink is propelled by movement of the brush.

2. The applicator of claim 1 wherein said brush comprises a core and plurality of bristles mounted on and substantially radially extending from said core.

3. The applicator of claim 2 wherein said means for moveably mounting said brush comprises means for rotatably mounting said core in said housing.

4. The applicator of claim 1 wherein said brush has a substantially cylindrical configuration.

5. The applicator of claim 1 wherein said means for moveably mounting said brush comprises means for rotatably mounting said brush.

6. In combination, a toy ink applicator and an ink containing marker having an end with an exposed felt tip, the applicator comprising a power source, a hand held housing including a depressible actuator, a motor with a drive shaft, means for connecting said power source to energize said motor when said actuator is depressed, a brush, means for moveably mounting said brush within said housing, means for operably drivingly connecting said drive shaft and said brush to move said brush when said motor is energized, a first opening in said housing adapted to receive said end of said marker such that the moving brush contacts and removes ink from the felt tip and a second opening in the housing through which ink is propelled by movement of said brush.

7. The combination of claim 6 wherein said felt tip has an inclined surface and an axis.

8. The combination of claim 7 wherein said brush comprises a plurality of substantially radially extending bristles with ends and wherein said ends of said bristles contact said inclined surface when said brush moves.

9. The combination of claim 8 wherein said brush rotates about an axis substantially perpendicular to said axis of said felt tip.

10. The combination of claim 6 wherein said brush has a substantially cylindrical configuration.

11. The combination of claim 6 wherein said means for moveably mounting said brush comprises means for rotatably mounting said brush.

12. The combination of claim 6 wherein said felt tip has a conical surface.

* * * * *